United States Patent [19]

Ramseyer

[11] Patent Number: 4,787,372

[45] Date of Patent: Nov. 29, 1988

[54] MASSAGING HEAD AND FACE MASK

[76] Inventor: Keith Y. Ramseyer, P.O. Box 409, Magalia, Calif. 95954

[21] Appl. No.: 111,747

[22] Filed: Oct. 23, 1987

[51] Int. Cl.[4] ..... A61H 1/00

[52] U.S. Cl. ..... 128/24 R; 128/52; 128/62 R

[58] Field of Search ..... 128/24 R, 76 B, 76 R, 128/51, 52, 44–46, 380, 163, 164, 62 R, 68; 604/303

[56] References Cited

U.S. PATENT DOCUMENTS

| | | | |
|---|---|---|---|
| 686,670 | 11/1901 | Fitzgerald | 604/303 |
| 1,963,237 | 6/1934 | Knauth | 128/164 |
| 1,965,424 | 7/1934 | Mascolo | 604/303 |
| 2,134,640 | 10/1938 | Merkin | 128/163 |
| 2,191,080 | 2/1940 | Lewis | 128/380 |
| 3,323,517 | 6/1967 | Keller | 128/380 |
| 4,052,981 | 10/1977 | Bachmann | 128/36 |
| 4,239,037 | 12/1980 | Fausone | 128/76 B |

*Primary Examiner*—Edgar S. Burr
*Assistant Examiner*—Huong Q. Pham
*Attorney, Agent, or Firm*—Lothrop & West

[57] ABSTRACT

A posterior carapace and an anterior carapace are fitted snugly on the scalp and peripheral facial areas, respectively, so that relative movement of the carapaces toward and away from each other causes corresponding movement of the skin underlying the carapaces. A motorized crank on one carapace and connecting tether from the other carapace provides the reciprocating movement which is 180° out of phase.

8 Claims, 2 Drawing Sheets

MASSAGING HEAD AND FACE MASK

BACKGROUND OF THE INVENTION

The invention relates to devices for massaging the skin on selected portions of the scalp and face of human beings to enhance the skin tone of such areas.

The most pertinent prior art known to applicant are the following United States Patents:

Fitzgerald U.S. Pat. No. 686,670 of Nov. 12, 1901 for Dermal Steaming Apparatus For The Head;

Rodelli U.S. Pat. No. 3,211,146 of Oct. 12, 1965 for Perforated Medicating Face Mask;

Ediin U.S. Pat. No. 3,345,987 of Oct. 12, 1967 for Pressurized Face Mask;

Sobel U.S. Pat. No. 3,709,225 of Jan 9, 1973 for Figure Contouring Mask.

These patents were cited but not applied in copending design patent application, Ser. No. 06/752,269 filed July 5, 1985.

Applicant does not consider any of these references, taken either distributively or in combination, to be anticipatory of his concept, nor does he feel that his invention lacks unobviousness relative to their disclosures.

RELATED APPLICATIONS

Design patent application Ser. No. 06/752,269 filed July 5, 1985, for Massaging Head And Face Mask in the name of Keith Y. Ramseyer.

SUMMARY OF THE INVENTION

A posterior carapace of semi-rigid or rigid material is shaped so as to cover snugly the back and top of the head; and an anterior carapace of semi-rigid or rigid material is shaped so as to cover snugly the face except for the eyes, nose and upper lip. Elastic bands with reciprocal pairs of Velcro® pads position the two carapaces on the head and face, and afford relative movement between the two carapaces.

A below-the-chin web of elastic material is mounted on the bottom of the anterior carapace to bear against the wattle, if any, of the user; and an encircling neckband of elastic material can be used as a buffer to help prevent abrasion of the skin of the neck where touched by the adjacent web.

A small, geared-down, electric motor is mounted on the forward portion of the posterior carapace and drives a crank which can be selectively engaged with the bight of a tether having its opposite ends secured to the respective forehead and cheek portions of the anterior carapace.

When the motor is switched on, the motion of the crank arm alternately lifts, and allows gravity and skin elasticity to lower, the anterior carapace. By reaction, the posterior carapace is reciprocated in a fore and aft direction in opposite phase relationship to the movement of the anterior carapace.

The snug engagement between the interior surfaces of the masks and the underlying epidermis causes the skin to partake of at least a portion of the alternating movement of the carapaces.

SHORT DESCRIPTION OF THE DRAWING FIGURES

DETAILED DESCRIPTION OF PREFERRED EMBODIMENT

Figure 1:
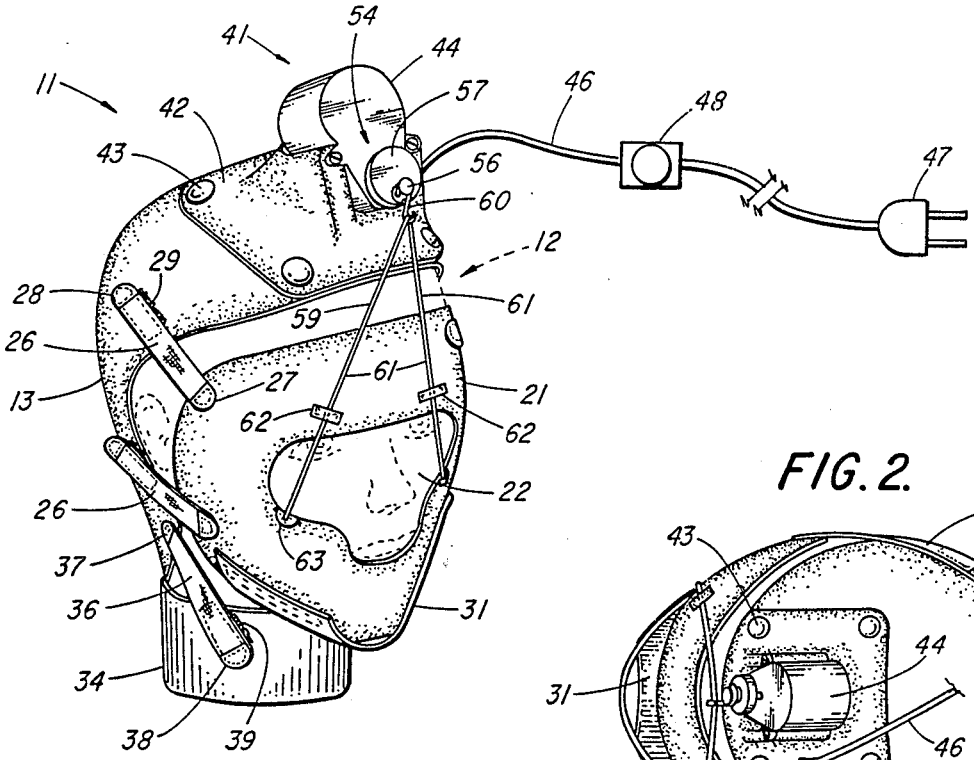
FIG. 1 is a right front perspective view showing the mask installed on a human head appearing in broken line.
Figure 2:
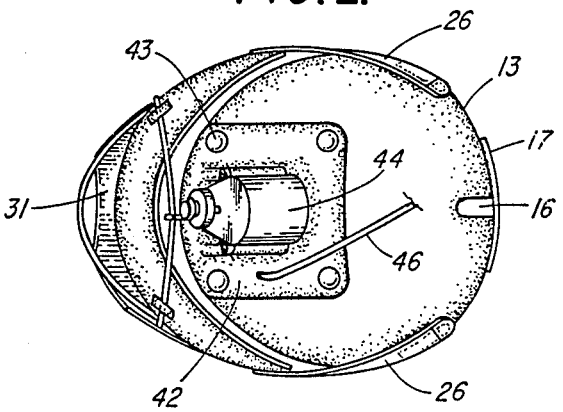
FIG. 2 is a top plan view.

While the massaging head and face mask of the invention, generally designated by the reference numeral 11, is susceptible of various different embodiments, depending upon the requirements of use, several of the herein shown and described embodiments have been made and tested and have performed in satisfactory manner.

In order to facilitate installation on and removal from the head 12 of a human being the mask is formed in two parts.

Shaped so as to fit snugly on the back and top of the head is a posterior carapace 13, or covering, or shell, of semi-rigid or rigid material, such as molded polyurethane. A vertical slot 16 in the aftermost portion of the carapace 13 affords some tolerance to accommodate the fitting of the mask to various head sizes, although the commercial versions of the device are fabricated in several different sizes to cover the usual range of adult head sizes.

A plurality of rear head bands 17, or straps, of elastic material, can be adjusted to close the slot 16 somewhat in order to afford a snug fit giving best results. Although not shown, it is desirable to place a hair net over the user's hair prior to installing the posterior carapace 13 on the rear and top portions of the scalp so as to control unruly or abundant hair.

One end 18 of each of the rear head bands 17 is secured, in any suitable fashion, such as by an adhesive or by stitching, to the posterior carapace; and the opposite end 19 is disengagingly attached to the surface of the carapace by reciprocal pairs 20 of elongated strips of Velcro.

Spaced forwardly from the posterior carapace 13 is an anterior carapace 21, or covering, or shell, shaped to cover snugly, most of the user's forehead as well as the opposite cheeks and jaws and the chin.

A symmetrical opening 22 in the anterior carapace 21 exposes the eyes, nose and upper lip; and the opposite forward sides of the posterior carapace 13 are shaped to expose the user's ears.

Opposite pairs of elastic bands 26, or straps, anchored at one end 27 on the anterior carapace 21 and removably connected at the other end 28 to the posterior carapace 13 by reciprocal pairs of Velcro pads 29 allow the user, or another person, to fit the mask comfortably, yet snugly, on the user's head.

Figure 3:
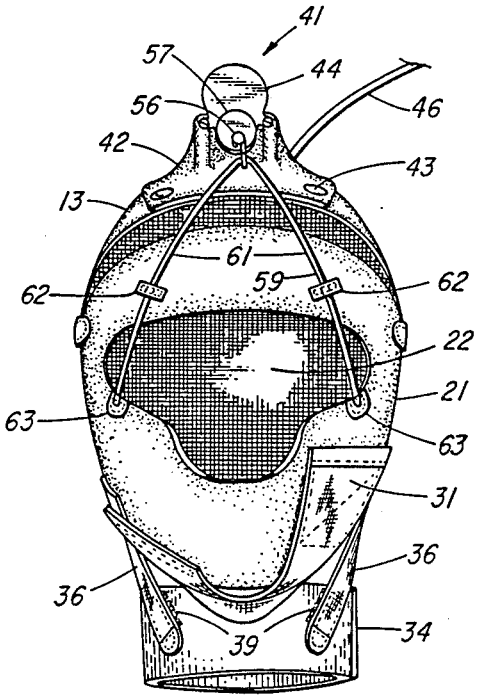
FIG. 3 is a front elevational view.
Figure 4:
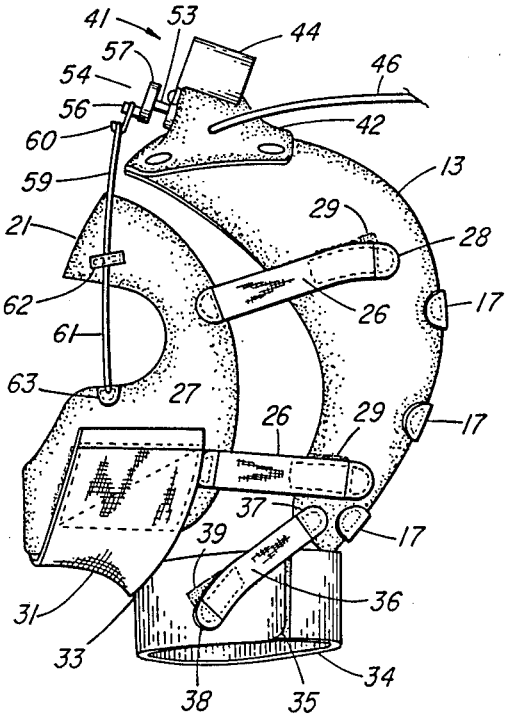
FIG. 4 is an elevational view of the left-hand side in base position, the right-hand side being substantially a mirror image thereof.
Figure 5:
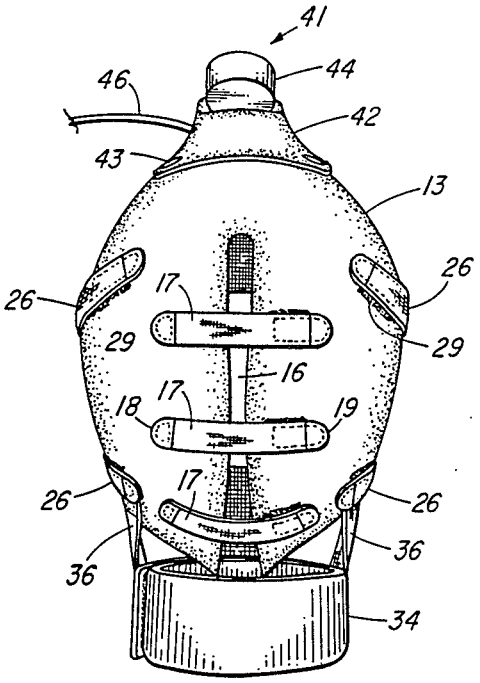
FIG. 5 is a rear elevational view.

Preferably, a web 31 of elastic material is mounted as by stitching or adhesive, on the bottom of the anterior carapace 21, as appears most clearly in FIG. 3; and in base position of the device, the web 31 bears upwardly against the wattle, or depending flesh, which sometimes forms below the chin of some users.

The rear, or after edge 33 of the web 31 extends to the neck and partially around the front of the neck; and, in order to prevent abrasion of the skin of the neck by the after edge 33 of the web during operation of the device a neckband 34 of elastic material is placed around the neck and serves as a buffer to the after edge 33 of the web.

Figure 6:
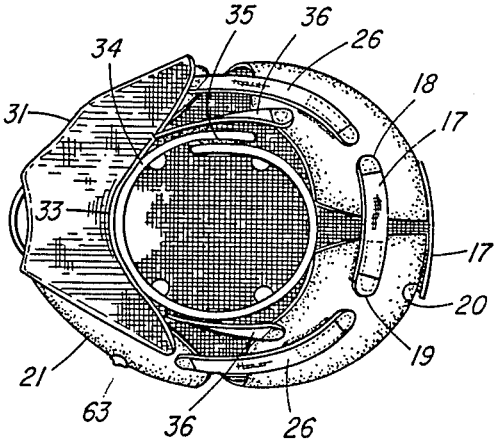
FIG. 6 is a bottom plan view.
Figure 7:
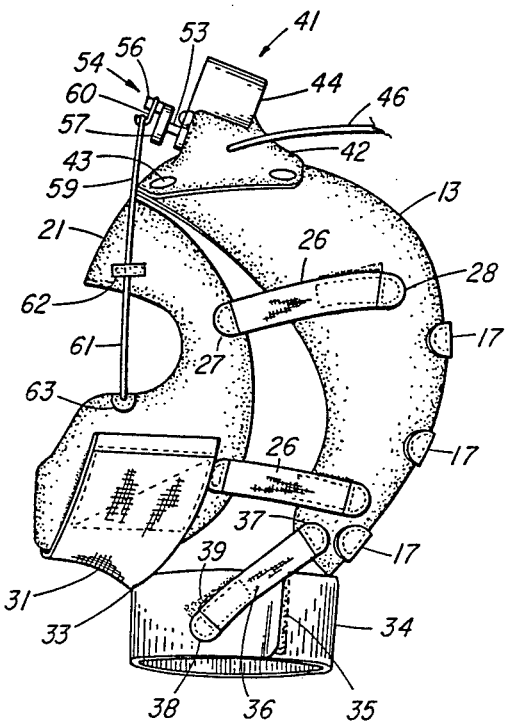
FIG. 7 is a view similar to FIG. 4 but with the two carapaces in positions of maximum displacement; and, FIG. 8 is a front elevational view, to an enlarged scale, illustrating in full line the position of the crank in base position corresponding to FIG. 4 and in broken line the position of the crank in maximum displacement, corresponding to FIG. 7.

Reciprocal Velcro pads 35 (see FIG. 6) on the neck band 34 hold the neck band in place; and a pair of opposite straps 36 of elastic material secured at one end 37 to the bottom of the posterior carapace and at the other end 38 by a pair of reciprocal Velcro pads 39 on the neck band help further to position the posterior carapace 13 firmly on the head.

In order to cause the skin on the portion of the face covered by the anterior carapace 21 to reciprocate vertically through a distance of approximately ⅛ inch to 3/16 inch, or so; and the skin on the scalp covered by the posterior carapace to reciprocate in a generally fore and aft direction by a similar amount, I have provided a motorized alternating attachment, generally designated by the reference numeral 41.

A motor mount 42 is attached in any suitable manner, such as by an adhesive or by snap buttons 43, to the forward area of the posterior carapace 13. The mount 42 is shaped to provide a cradle which carries a small electric motor 44 connected by an electrical conductor 46 to a plug 47 for attachment to a convenient electrical outlet (not shown).

A timer 48, preferably manually adjustable, is inserted in the line 46 to afford the user ready control over the length of the massage; and the timer is preferably of the kind which opens the circuit to deactivate the motor at the conclusion of the period set so that the action ceases even though the user might drop off to sleep during the course of the massage. A maximum time setting of 15 minutes would be appropriate.

The rotational speed of the motor is greatly reduced by a suitable reduction gear (not shown) integral with the motor 44 within the motor housing. Thus, the shaft 53 protruding from the motor 44 rotates at a relatively low speed.

In order to convert rotary to reciprocating or alternating motion a crank mechanism 54 is provided. In this instance the crank mechanism 54 includes a pin 56 mounted eccentrically on a circular disc 57 located coaxially on the outer end of the slowly rotating shaft 53.

The throw of the crank, i.e. the radial distance between the center of the circular disc 57 and the pin 56, is on the order of ⅜ inch. Thus, the maximum travel of the pin is about ¾ inch.

The circular motion of the crank mechanism 54 is translated to an essentially linear vertical movement, although with some slight lateral components, by disengagingly attaching to the crank pin 56 the bight 58 of a tether 59, an S-hook 60 providing a convenient connector.

The opposite runs 61 of the tether 59 are firmly secured to the respective opposite sides of the anterior carapace 21 by anchor pads 62 in the forehead area and anchor pads 63 in the cheek area.

Thus, when the timer is set and the motor turned on, the crank mechanism 54 causes the attached tether to move upwardly as the crank pin 56 travels from bottom position to top position. Upward movement of the tether results in upward movement of the anterior carapace 21 and the facial skin in contact therewith; and, by reaction, forward movement of the scalp portion of the posterior carapace 13.

Figure 8:
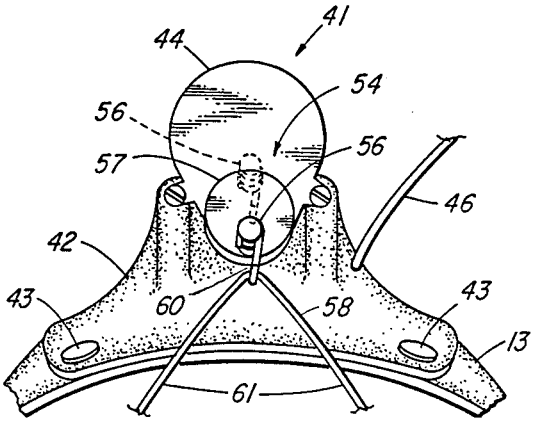

In turn, the portion of the scalp in contact with the posterior carapace 13, albeit with intervening hair and hairnet, is frictionally urged forwardly until the crank pin 56 reached its maximum height, as shown in broken line in FIG. 8. At this point the two carapaces are in positions of maximum displacement from base position.

Opposing the movement of the adjacent edges of the two carapaces toward contact with each other as the pin 56 moves upwardly is, first, the elasticity of the skin and, second, the elasticity of certain of the various straps connecting the two carapaces in their base, or at rest, position.

Thus, when the crank pin 56 swings over center at the top of its movement and begins to descend on the other arcuate leg of its travel, the combined elasticity of the skin and the elastic bands, or straps, tends to return the carapaces to their base position.

Consequently, as the pin 56 moves to its lowest point the adjacent edges of the two carapaces move away from each other and the skin areas return to an "at rest" condition.

The foregoing cycle is repeated for any desired period of time; for example, 10 to 12 minutes every day, at the beginning, for a period of 2 months. Then, the cycle speed is repeated every other day for 10 to 12 minutes. The cycle can range from approximately 40 per minute to approximately 70 per minute.

It should again be noted that by action and reaction, the anterior carapace and the posterior carapace move in unison but are 180° out of phase. Since the throw of the crank pin is ⅜ inch and the maximum vertical movement of the pin from bottom to top and top to bottom is therefore ¾ inch, and since each carapace partakes of approximately one-half the total movement, the maximum displacement of the skin on the scalp and on the covered portions of the face is about ⅜ inch.

I claim:

1. A massaging head and face mask comprising:

a. a posterior carapace having a rearward portion shaped to cover the back of a human head and a forward portion shaped to cover the top of a human head;

b. an anterior carapace shaped to cover the forehead, jaw and chin but leaving the eyes, nose and upper lip uncovered;

c. a tether anchored at opposite ends to opposite sides of said anterior carapace, said tether including a bight extending upwardly toward said forward portion of said posterior carapace;

d. an electric motor mounted on said forward portion of said posterior carapace;

e. means interconnecting said motor and said bight for reciprocating said tether, said posterior carapace and said anterior carapace during operation of said motor; and, f. elastic means for positioning said carapaces on the head, the reciprocation of said tether and said carapaces being yieldably resisted by said elastic means.

2. A device as in claim 1 in which said elastic means includes an elastic web spanning a bottom portion of said anterior carapace and underlying the chin, said web extending from the forward portion of the chin rearwardly to the vicinity of the neck.

3. A device as in claim 2 including an elastic neckband, the front portion of said neckband being interposed between the rearward portion of said web on the bottom of said anterior carapace and the neck to buffer the skin of the neck against abrasion resulting from the reciprocation of said anterior carapace.

4. A device as in claim 1 in which said electric motor includes gear means for reducing the speed of reciprocation of said tether and said anterior carapace.

5. A device as in claim 4 in which said reciprocating means includes a crank.

6. A device as in claim 5 in which said crank comprises a circular disc mounted on said electric motor; a pin mounted eccentrically on said disc; and means on said pin for removably engaging said bight.

7. A device as in claim 5 in which the throw of said crank is approximately $\frac{3}{8}$ inch.

8. A device as in claim 4 including an electrical conductor connected to said motor and a timer inserted in said conductor.

* * * * *